United States Patent [19]

Bullock

[11] 4,447,705

[45] May 8, 1984

[54] HAIR CURLERS HAVING PTC ELECTRIC HEATING ELEMENT

[75] Inventor: James H. Bullock, Trumbull, Conn.

[73] Assignee: Clairol Incorporated, New York, N.Y.

[21] Appl. No.: 270,434

[22] Filed: Jun. 4, 1981

[51] Int. Cl.[3] ..... A45D 2/36; H05B 1/00

[52] U.S. Cl. ..... 219/222; 132/9; 132/33 R; 132/33 F; 132/40; 132/41 R; 219/242; 219/505; 219/541; 338/22 R; 338/328

[58] Field of Search ..... 219/222–226, 219/241, 242, 504, 505, 530, 540, 541; 132/33 R, 33 F, 40, 41 R, 9; 338/22 R, 328

[56] References Cited

U.S. PATENT DOCUMENTS

| | | | |
|---|---|---|---|
| 3,214,719 | 10/1965 | Turner | 338/22 R |
| 3,375,774 | 4/1968 | Fujimura et al. | 338/22 R |
| 3,414,704 | 12/1968 | Flanagan | 219/505 X |
| 3,617,695 | 11/1971 | Meyer et al. | 219/222 |
| 3,673,382 | 6/1972 | Gaffney et al. | 219/222 |
| 4,097,718 | 6/1978 | Weise | 219/222 |
| 4,284,877 | 8/1981 | Abura et al. | 219/222 |
| 4,341,949 | 7/1982 | Steiner et al. | 219/540 |
| 4,346,285 | 8/1982 | Nakamura et al. | 219/505 X |

FOREIGN PATENT DOCUMENTS

| | | | |
|---|---|---|---|
| 2837210 | 3/1979 | Fed. Rep. of Germany | 219/222 |
| 45-4671 | 3/1970 | Japan | 219/222 |
| 53-89556 | 8/1978 | Japan | 219/222 |
| 1540482 | 2/1979 | United Kingdom | 219/222 X |

*Primary Examiner*—A. Bartis

*Attorney, Agent, or Firm*—Issac Jarkovsky; John J. Balser; Gerald S. Rosen

[57] ABSTRACT

An electrically heated hair curler or roller suitable for use in, for example, a hair setter contains therein a self-regulating heater comprised of a positive temperature coefficient (PTC) thermistor material. The PTC is in the shape of a flat pill or disc. There are no holes in the PTC, thus enabling it to maintain its integrity under stress. There are two cup shaped heat sinks, the bottoms of which rest against the flat faces of the PTC in electrical and heat conducting contact therewith. The heat sinks are held firmly against the PTC element by electrically conductive rivets or other connectors through holes in the bottoms of the heat sinks and depressions in the circumference of the PTC. A male positive electrical contact pin extends down from the inside face of the bottom of the lower heat sink. A negative electrical contact ring is around the pin and separated therefrom by a plastic insulating sleeve. The base of the contact ring has a leg through which one of the rivets fits and is in electrical contact with the rivet. The rivets are electrically insulated from the lower heat sink and the PTC thermistor. The heater is powered by electricity, which is conducted to the contact pin through a plug in a post in a hair setter stand.

6 Claims, 10 Drawing Figures

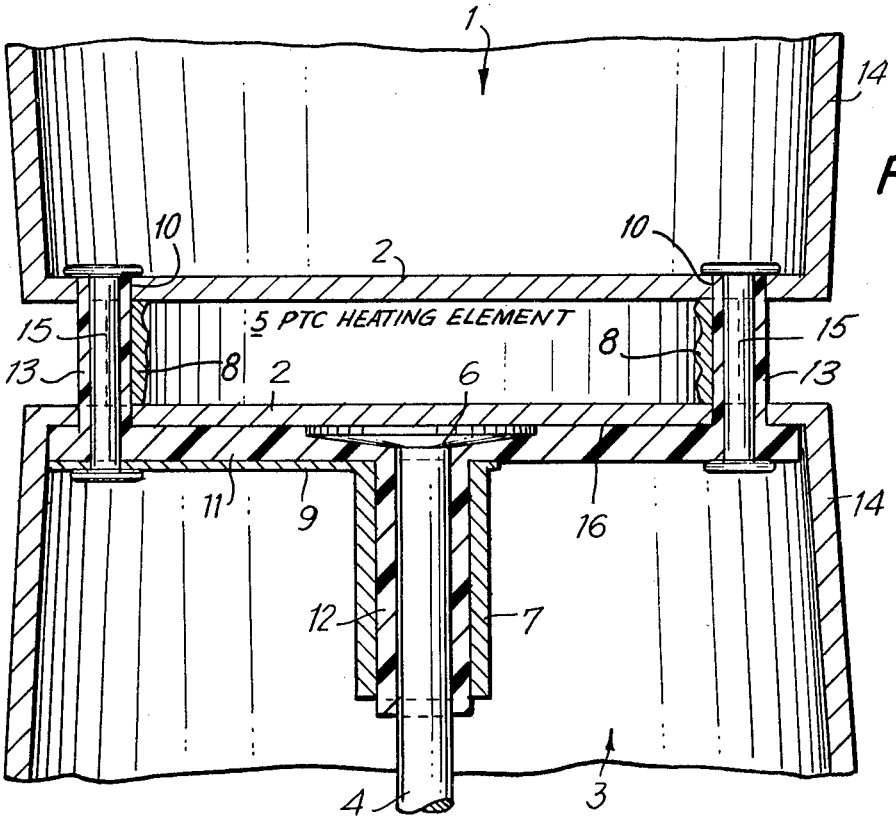
FIG. 1
FIG. 2
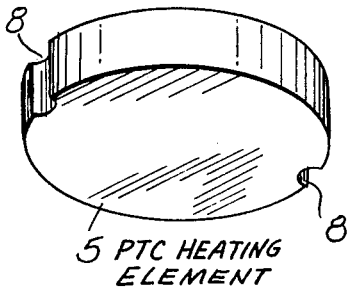
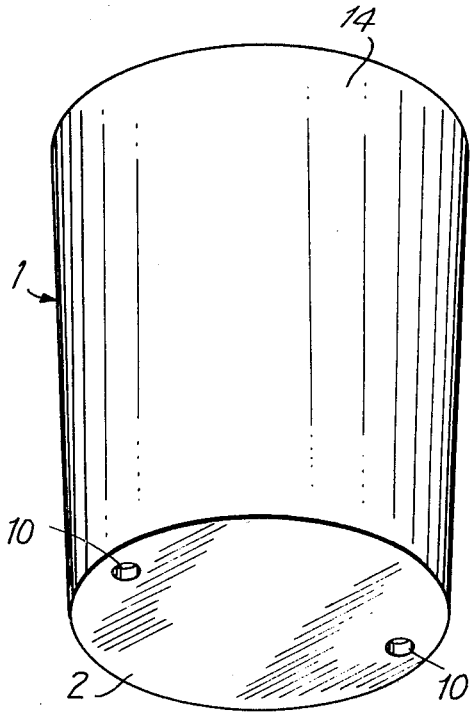
FIG. 3

HAIR CURLERS HAVING PTC ELECTRIC HEATING ELEMENT

DESCRIPTION

Background

This invention relates to electrically heated hair curlers and rollers containing as a self-regulating heater, a positive temperature coefficient (PTC) thermistor material which heats the curler or roller body quickly via heat sinks and maintains the temperature of the curler substantially constant during heating, and to the heater structure in said curler or roller.

Hair curlers and rollers of the prior art containing PTC thermistors are generally of two types, (a) those in which the axis of the PTC thermistor is perpendicular to the longitudinal axis of the curler, e.g. curling irons, and (b) those in which the axis of the PTC thermistor is concentric with the longitudinal axis of the curler, e.g. hair setters.

The former are directly connected to the power cord and ordinarily no electricity passes through heat sinks which convey heat from the PTC to the curler. These are exemplified by, for example, Weise, U.S. Pat. No. 4,097,718 issued June 27, 1978; Meyer, et al, U.S. Pat. No. 3,617,695; and Toho, et al, Japan application S. No. 41-98506, published Mar. 4, 1970.

An example of the latter is shown in Matsushita Electric Works, German D.T. No. 2,837,210 which discloses a hair curler with a PTC thermistor interposed between a pair of bottomed metallic cylinders which act as electrode plates and heat sinks. Two connections joined to one of the electrode plates have an electrical insulator between them and form a pin shaped male plug. One end of the plug fits through the heating element in the electrode plates and the other end protrudes along the longitudinal axis of the hair curler. This structure requires that the PTC thermistor be produced with a hole in its center resulting in a structural weakness which can cause cracking under stress.

Other hair curlers and rollers using PTC thermistor heaters are made of various PTC thermistor materials and compositions and have different shapes.

Gaffney, U.S. Pat. No. 3,673,382 discloses electrically heated cylindrical shaped plastic hair curlers having an electrical resistance heating element positioned within the hair curler for heat generation. Heat sinks for conducting the heat from the resistance heating element to the inside cylindrical walls of the hair curler are positioned within the inside walls of the curler. Gaffney uses two resistors for each curler.

Philips, Great Britain Pat. No. 1,540,482 discloses a self-regulating heating element (PTC thermistor) within a cylindrical casing. The PTC thermistor is sandwiched between and in thermal contact with heat sinks. The PTC thermistors are preferably flat and may also be circular, hexagonal, square, rectangular or any other convenient shape. The opposed major faces of the flat PTC thermistors are connected to heat sinks. Electrical contact between the PTC thermistor and the heat sinks can be effected by soldering or by an electrically conducting paste.

Flanagan, U.S. Pat. No. 3,414,704 discloses a self-regulating PTC thermistor which is in the form of a hollow cylinder defining a cavity. It heats the cavity.

Turner, U.S. Pat. No. 3,214,719 discloses a thermistor device in which a heat shrunk dielectric material surrounds the body of a PTC thermistor and holds electrical leads in electrical contact with the PTC thermistor.

Even though the prior art PTC thermistors operate reasonably satisfactorily in hair curlers and rollers, they present problems of production, reliability, and cost. There is thus a need for a PTC thermistor device for use in hair curlers and rollers which is relatively easily and economically produced and is reliable and stable in performance.

BRIEF SUMMARY OF THE INVENTION

An object of this invention is to provide a hair roller with an easy to manufacture, reliable and stable self-regulating heating element comprising a PTC thermistor in the shape of a solid flat disk or pill with two major flat faces opposite each other. It is electrically connected to heat sinks which are in physical heat conducting contact with the opposite major flat faces of the PTC and are imbedded in the walls of the roller. Another object of this invention is to provide a PTC thermistor heater element wherein the PTC is a solid disk or pill shape with two opposite flat faces without any holes therein and which is in heat conducting contact and electrical contact with the bottoms of cup shaped heat sinks on the large surfaces thereof.

The objects of this invention are fulfilled by providing electrically heated hair rollers having therein cup shaped metallic heat sinks, the bottoms of which are disposed facing each other and having therebetween a flat disc or pill shaped PTC thermistor. The bottoms of the heat sinks are held tightly to the PTC thermistor by electrically conductive connectors such as rivets which are placed in holes near the outer periphery of the bottoms. The connectors pass through recesses in the outer periphery of the PTC thermistor. There is an electrically conducting pin with a head on one end and which is surrounded by an outer contact ring. The pin faces downward and its head is in electrical contact with the bottom of the lower heat sink. The other end of the pin plugs into an electrical socket in a hair setter post. The pin and outer ring are insulated from each other. The outer ring is an electric contact which also fits into the socket in the hair setter post. The outer ring has an elongated flange with a hole into which fits the connector holding the heat sinks against the PTC. The ring and flange are insulated from the lower heat sink by an insulator spacer made of moldable plastic. The connectors are insulated from the PTC thermistor but are in electrical contact with the upper heat sink which is also in electrical contact with the top flat face of the PTC thermistor.

The side walls of the heat sinks are imbedded in the walls of the roller and have the same shape as the roller walls, usually cylindrical.

The roller is preferably made of molded heat-resistant plastic, such as polypropylene. The heat sinks are made of electrically and heat conductive material, preferably a metal such as aluminum.

The connectors, which are preferably rivets, are made of an electrically conductive material such as brass or steel.

The PTC thermistor is ordinarily disposed in the roller at about its longitudinal center. The longitudinal axes of the cylindrical roller and the PTC thermistor through the center of its top and bottom large flat surfaces are concentric.

The insulator is moldable plastic material which is a nonconductor of electricity and is preferably a single piece.

BRIEF DESCRIPTION OF THE DRAWINGS

FIG. 1 is a side sectional view of the PTC thermistor heater of this invention;

FIG. 2 is a perspective view of the PTC thermistor;

FIG. 3 is a perspective view of the heat sinks taken from the outside bottom angle;

DETAILED DESCRIPTION OF THE INVENTION

Figure 4:
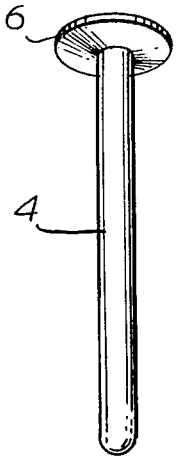
FIG. 4 is a side perspective view of the contact pin.

As depicted in FIG. 1, the PTC thermistor 5 is of generally circular flat disc shape with recesses 8 in the circumference as shown in FIG. 2. The PTC thermistor 5 is made of ceramic materials which are conventionally used to make positive temperature coefficient thermistors such as $BaTiO_3$ or $BaTiO_3$ and $SrTiO_3$ in a sintering process. In order to achieve the desired temperature effect, higher valent ions can be used to replace part of the barium and titanium ions. As examples, barium can be replaced by $La^{3+}$ or $Bi^{3+}$ and titanium can be replaced by $Sb^{5+}$ or $Nb^{4+}$. The PTC useful in the present invention should have the capability of quickly heating the hair roller or curler to about 95° C. to 105° C., with 105° C. the maximum. It should maintain the curler or roller at that temperature when it is plugged into a post on a hair setter stand. The opposite major faces of the PTC thermistor 5 must be substantially flat to make certain that there is good contact between the upper heat sink 1 and the top face of the PTC thermistors, as well as the lower heat sink 3 with the lower face of the PTC thermistor 5.

The heat sinks 1 and 3 are cup shaped with flat bottoms 2. The flat bottoms 2 each have two holes 10 near their periphery as shown in FIG. 3. These holes or eyelets can receive electrically conductive connectors or rivets 15 which pass through the recesses 8 in the PTC thermistor 5. The rivets 15 hold the bottoms 2 of the heat sinks 1 and 3 tightly against the flat faces of the PTC thermistor 5. The bottoms 2 of the heat sinks 1 and 3 are thus in electrical and heat conducting contact with the PTC thermistor 5.

Figure 7:
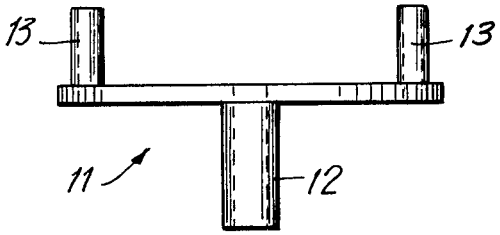
FIG. 7 is a side view of the insulator spacer.
Figure 6:
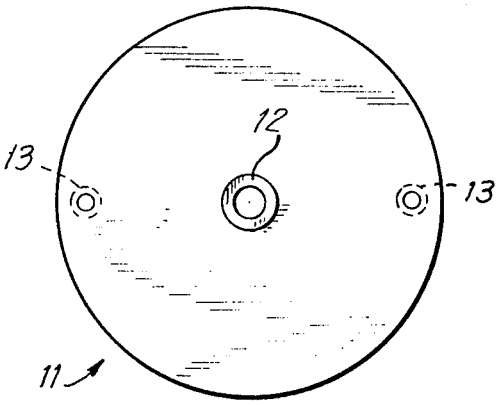
FIG. 6 is a bottom view of the insulator spacer.

The rivets 15 are insulated from the PTC thermistor 5 by sleeves 13 on the insulator spacer 11, shown in FIGS. 6 and 7. These sleeves 13 fit into the eyelets 10 in the bottoms 2 of the lower heat sink 3 and also in the recesses 8 of the PTC thermistor 5. The sleeves 13 are integral with the insulator spacer 11 as shown in FIGS. 6 and 7. The sleeves 13 do not extend above the inside surface of the bottom 2 of the upper heat sink 1 because the rivets 15 must be in electrical contact with the upper heat sink 1.

Figure 5:
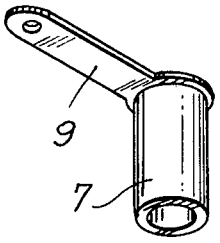
FIG. 5 is a perspective view of the contact ring with an elongated flange.
Figure 8:
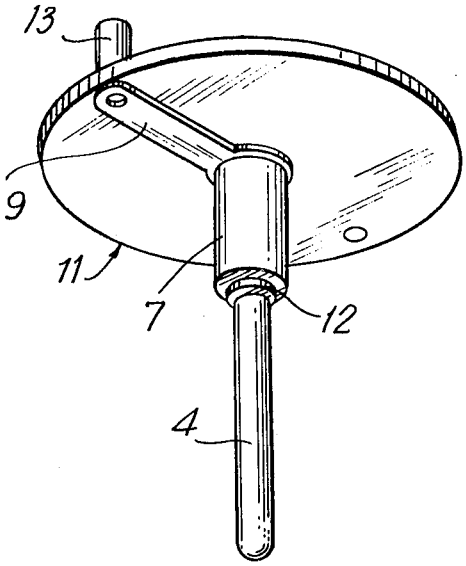
FIG. 8 is a perspective view showing the contact pin and contact ring assembled.

The insulator spacer 11 is placed against the inside face 16 of the bottom 2 of the lower heat sink 3. The insulator spacer 11 has a center sleeve 12 extended downward as shown in FIGS. 1, 6 and 7 which receives a contact pin 4. The contact pin 4 is shaped like a flat head nail and its flat head 6 is placed in electrical contact against the inside face 16 of the bottom 2 of the lower heat sink 3. The center insulator sleeve 12 spaces the pin 4 from the outer contact ring 7. The contact ring 7, depicted in FIGS. 5 and 8, fits around the center insulator sleeve 12 and has an extended leg 9 with a hole, which leg rests on the insulator spacer 11. The insulator spacer 11 is on the inside bottom 16 of the lower heat sink 3. The hole in the extended leg 9 fits over the eyelet 10 and the sleeve 13 on the heat sink inside bottom 16 and the insulator spacer 11, respectively, as shown in FIG. 8. A rivet 15 passes through the hole in the leg 9 and is in electrical contact therewith. The outer contact ring 7 may have two legs 9 to accommodate more than one rivet 15, but this is not necessary or even a preferred embodiment.

Figure 9:
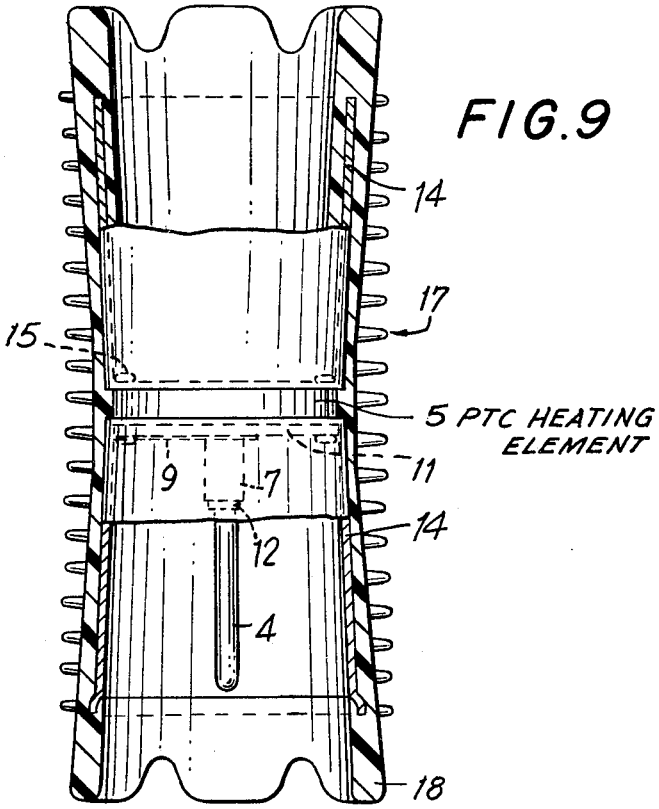
FIG. 9 is a side sectional view of a hair roller containing the PTC thermistor.

The side walls 14 of the heat sinks 1 and 3 are generally circular in shape or conform to the shape of the walls 18 of the roller or curler 17 and are imbedded in the walls as shown in FIG. 9.

Figure 10:
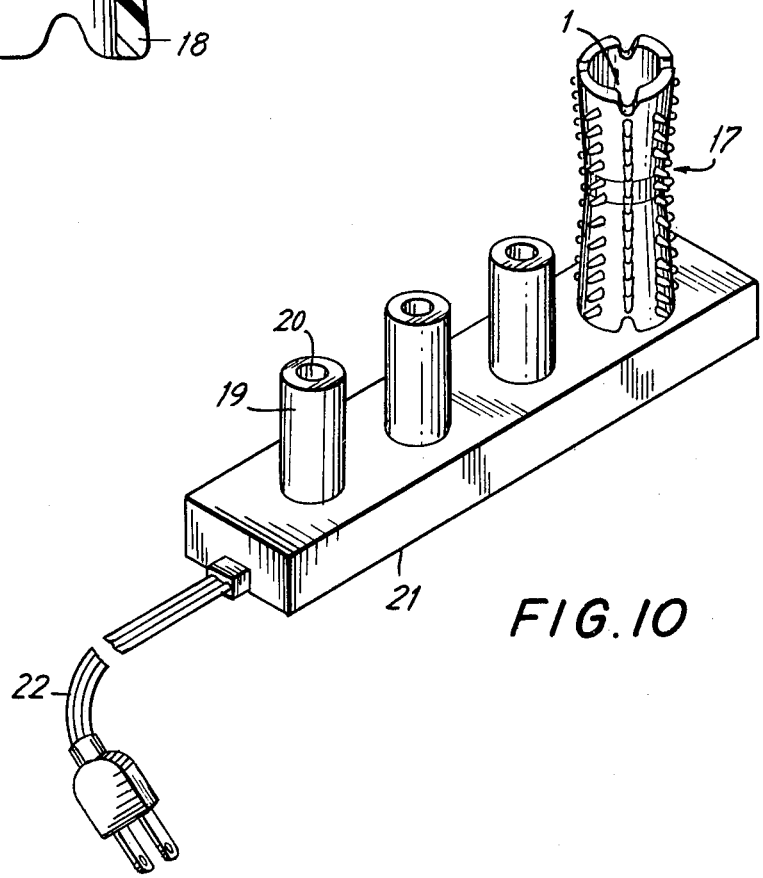
FIG. 10 is a perspective view of a PTC post-heater stand showing a hair curler thereon.

A stand for heating the hair curler of this invention is shown in FIG. 10. In operation the roller 17 with the PTC heater is placed on a post 19 with an electrical socket 20 on a hairsetter stand 21 as shown in FIG. 10 so that the contact pin 4 and contact ring 7 are inserted into the socket 20. Electric power provided by power cord 22 then passes through the socket contacts into the contact pin 4 which is the positive terminal. The electricity then passes to the bottom 2 of the lower heat sink 3, through the PTC thermistor to the bottom 2 of the upper heat sink 1. This heats the PTC thermistor whereby the heat sinks pick up the heat and conduct it to the walls 18 of the roller thereby heating the roller. The electricity then passes through the rivert 15 and through the extended leg 9 of the outer contact ring 7 into the negative terminal in the socket 20, completing the circuit.

Because of the positive temperature characteristics of the heater, the temperature of the roller is maintained constant at the desired level, no matter how long it remains plugged in.

What is claimed is:

1. An electrically heated hair curler comprising a generally cylindrical member about which hair may be wound and containing as a self regulating heater, a positive temperature coefficient thermistor, wherein said positive temperature coefficient thermistor is a flat disc having electrically and heat conducting cup shaped heat sinks on the opposite flat faces thereof, the outside bottoms of said heat sinks being in heat conducting and electrical contact with said thermistor and held tightly against said faces by electrically conductive connectors positioned through holes in the bottoms of said heat sinks and recesses in the outer circumference of said positive temperature coefficient thermistor, said connectors being electrically insulated from said thermistor and one of said cup-shaped heat sinks and electrically connected to the other of cup-shaped heat sinks; an electrical contact pin in electrical contact with the inside of the bottom of said one heat sink and held in place by a plastic insulator spacer; said insulator spacer having a sleeve in the center thereof around a portion of said pin which supports a ring electrical contact member and insulates it from said pin; said ring electrical contact member having a leg extending radially outward from the portion thereof and resting on the insulator spacer so as to be insulated from said one heat sink, said leg having a hole therein through which one of the connectors extends and is in electrical contact therewith; the positive temperature coefficient thermistor being positioned so the center point of the flat faces thereof is concentric with the longitudinal axis of said curler, the sides of said heat sinks being imbedded in said cylindrical member to conduct heat thereto.

2. The curler of claim 1 wherein said cylindrical member is made of polypropylene.

3. The curler of claim 1 wherein the contact pin has a flat head which is in electrical contact with the inside bottom of said one heat sink.

4. A self-regulating heater structure suitable for use in a hair curler comprising a flat disc shaped positive temperature coefficient thermistor having recesses in the outer periphery thereof; cup shaped electrical and heat conductive heat sinks having their outside bottom surfaces in electrical and heat conductive contact with the flat surfaces of the positive temperature coefficient thermistor, said bottom surfaces having holes therein to match the recesses in the positive temperature coefficient thermistor and adapted to receive electrically conductive connectors for holding the surfaces against the flat faces of said positive temperature coefficient thermistor; and electrically conductive connectors positioned in the holes in the bottoms of the heat sinks and through the recesses in the positive temperature coefficient thermistor to hold the heat sinks in contact with said thermistor, said connectors being in electrical contact with one of said heat sinks and electrically insulated from the other heat sink and the thermistor; an electrical contact pin in electrical contact with and extending essentially perpendicular from the inside bottom of the heat sink which is insulated from said connector; an electrical contact ring with at least one leg extending radially therefrom, said ring encircling said contact pin and electrically insulated therefrom, said at least one leg having therein a hole which matches said holes in the bottoms of the heat sinks and through which the connector extends, said contact ring and said at least one leg being electrically insulated from said other heat sink and being in electrical contact with said connector; the contact ring and contact pin forming an electrical plug adapted to be inserted in an electrical socket; the heat sink side walls and bottoms being integrally formed and the sides being of a shape adapted to be in heat conducting contact with the inside surface of a cylindrical hair curler.

5. The self-regulating heater of claim 4 wherein the electrical insulation insulating the connectors from the other heat sink and the thermistor, said contact ring from said contact pin, and said contact ring and said at least one leg from said other heat sink is a one-piece molded plastic member.

6. The self-regulating heater of claim 4 wherein said electrical plug is adapted to fit into a socket in a post on a hair setter stand.

* * * * *